US005191699A

United States Patent [19]

Ganslmeier et al.

[11] Patent Number: 5,191,699

[45] Date of Patent: Mar. 9, 1993

[54] METHODS OF PRODUCING A CHIP-TYPE HF MAGNETIC COIL ARRANGEMENT

[75] Inventors: Michael Ganslmeier, Grafenhaun; Horst Wünschmann, München, both of Fed. Rep. of Germany

[73] Assignee: GW-Elektronik GmbH, München, Fed. Rep. of Germany

[21] Appl. No.: 754,587

[22] Filed: Sep. 4, 1991

[30] Foreign Application Priority Data

Sep. 4, 1990 [DE] Fed. Rep. of Germany ..... 4027994
Apr. 12, 1991 [EP] European Pat. Off. ..... 91105864

[51] Int. Cl.[5] ..... H01F 41/04

[52] U.S. Cl. ..... 29/602.1; 264/272.19; 336/65; 336/96; 336/200; 336/229

[58] Field of Search ..... 29/602.1, 606; 336/65, 336/229, 205, 200, 96; 264/272.19

[56] References Cited

U.S. PATENT DOCUMENTS 3,477,051 11/1969 Clark et al. .
3,486,149 12/1969 Klein .
4,536,733 8/1985 Shelly .

FOREIGN PATENT DOCUMENTS 3322004 of 0000 Fed. Rep. of Germany .
96356 6/1972 France .
245296 of 0000 German Democratic Rep. .
1-278707 of 0000 Japan .
86/00749 of 0000 World Int. Prop. O. .

OTHER PUBLICATIONS 1-278707, Patents Abstracts of Japan, E-882, Jan. 31, 1990, vol. 14, No. 55.

*Primary Examiner*—Carl E. Hall
*Attorney, Agent, or Firm*—Darby & Darby

[57] ABSTRACT

A miniaturized or chip-type HF magnetic-coil arrangement, e.g. a toroidal core transformer, comprising a basic body (1) of plastic material, which is provided with openings for magnetic cores (2), the upper side (10) and the lower side (11) of said basic body (1) including electric conductors (5) and the interior thereof being provided with plated-through holes in openings (16) to which the conductors (5) are connected in such a way that individual turns around the magnetic core are formed, said turns defining windings of coils (6, 7). Moreover, methods are provided, which permit a production of these arrangements in large numbers of pieces.

22 Claims, 4 Drawing Sheets

METHODS OF PRODUCING A CHIP-TYPE HF MAGNETIC COIL ARRANGEMENT

BACKGROUND OF THE INVENTION

The present invention refers to a chip-type HF magnetic-coil arrangement comprising an annular magnetic core, which is embedded in plastic material, and at least one winding, which extends through the magnetic core and which consists of at least one turn, the turns being composed of conductor elements extending parallel to the end face of the magnetic core and of conductor elements extending parallel to the axis of the magnetic core and embedded in embedding plastics.

The present invention additionally refers to methods of producing such HF magnetic-coil arrangements.

The increasing degree of miniaturization of electric circuits, which especially resulted in surface mounted devices—SMD—including socalled "chip"-type components, leads to the wish to produce also HF magnetic-coil arrangements, such as toroidal core transformers, inductors provided with magnetic cores, transformers, coils and the like, as chip-type components having very small dimensions. However, annular magnetic cores having an outer diameter of less than 6.3 mm and, accordingly, an inner diameter of the hole of less than 2 mm are practically no longer suitable for winding by means of an automatic winding machine. Although, in the case of an inner diameter of the hole of 2 mm, winding by hand is still possible, such winding is out of the question for large numbers of pieces because it is too expensive and, moreover, it does not result in the demanded close tolerances of the electric values. The winding shapes, which cannot precisely be observed in the case of this type of winding operation, will not only cause deviations as far as the inductance values are concerned but they will also result in a very large spread of the capacitance values.

U.S. Pat. No. 4,536,733 describes an HF transformer, which is provided with an annular core of ferrite material used for supplying energy and one winding of which consists of wire wound on the annular core, whereas the other winding consists of individual sheet-metal components having an adequate shape and providing, together with printed conductors on a circuit board, the turns of the winding. This type of embodiment is not applicable to the present invention.

JP-AS 1-278707, published in Patents Abstract of Japan, E-882, Jan. 31, 1990, Vol.14/No.55, describes a chip-type induction coil and a method of producing the same. This method includes the steps of producing at least two parallel rows of holes in a flat body of magnetic material. Between these rows of holes, conductors, which are arranged on the upper flat side of said body such that they extend parallel to one another and at right angles to the peripheral sides and on the lower flat side of said body again such that they extend parallel to one another, but at an acute angle to said peripheral sides, i.e. at an oblique angle above this flat side, are formed in such a way that they extend helically around the body and border on two respective holes on the lower flat side. The holes are metallized at their inner surfaces so that a circuit in the form of a coil is obtained. This structural design and this production method differ fundamentally from those according to the present invention because the conductors are applied directly to the body of magnetic material and because the body does not have an annular shape.

U.S. Pat. No. 3,477,051 describes a chip-type magnetic-coil arrangement comprising an annular magnetic core, which is embedded in plastic material, and at least one winding, which extends through the magnetic core and which consists of at least one turn, the turns being composed of conductor elements extending parallel to the end face of the magnetic core and of conductor elements extending parallel to the axis of the magnetic core and embedded in embedding plastics. In the case of this magnetic-coil arrangement, the embedding plastic is produced by injection molding around the whole annular core, i.e. on both end faces as well as on the circumferential surface and on the inner surface of the interior of the annular core, in one working cycle. In the course of this working cycle, the embedding plastic has simultaneously formed therein grooves in such a way that these grooves extend helically around the annular core according to the coil desired. Subsequently, these grooves will be filled with metal or their surfaces will be metallized so that a magnetic component will be obtained, which is provided with at least one winding consisting of turns. This component will then be attached to a carrier body or inserted into recesses of a carrier body having the shape of the chip with adequate connection and contact areas having electrically connected thereto the ends of the at least one winding.

U.S. Pat. No. 3,486,149 describes an improved production of the above-described magnetic-coil arrangement. The working cycle in the course of which plastic material is formed around the annular magnetic core includes, on the one hand, the step of enclosing this core by a body of plastic material provided with recesses for the turns of the coil and, on the other hand, also the step of producing a housing, which, in the course of this working cycle, is also provided with adequate recesses for conductors leading to connection areas as well as with plated-through holes. The housing preferably has a rectangular and flat structural design and one of its narrow lateral surfaces is provided with pins for insertion into holes of printed circuits. Hence, the component produced is not a chip-type component.

In contrast to the present invention, the magnetic-coil arrangements described in these two U.S. patent specifications include as conductor elements, at least on the two end faces and in the interior of the core, grooves, which are metallized on their inner surfaces and which are already produced when the envelope of plastic material is being manufactured in an enveloping work cycle by means of an adequately constructed, complicated injection molding tool; in the case of this work cycle, it will be necessary to move each magnetic core past this tool or to provide a plurality of such tools, if efficient production is to be guaranteed. Moreover, the step of filling the interior of the core with plastic material does not constitute part of the enveloping step so that this will require an additional work cycle, if, e.g. for reasons of insulation, the interior or also all conductors are to be covered with plastic material. However, the HF solenoid arrangement according to the present invention differs from the known embodiments especially with regard to the fact that the conductors provided on the end faces are not arranged in grooves, but on the surfaces, and that the electric connections interconnecting the conductors of the two end faces are provided in holes outside and inside of the core. The advantages resulting therefrom with regard to the structural design and the production process will be explained within the framework of the description of the present invention.

SUMMARY OF THE INVENTION

The present invention is based on the task of providing an HF magnetic-coil arrangement of the type described at the beginning, in particular a toroidal core transformer arrangement, which can be produced fully or largely mechanically and in very high numbers of pieces, which has in its finished condition electrical properties which are very uniform in dependence on the frequency as well as for the given number of pieces, and which can easily be installed in SMD circuits.

Within the scope of the present invention, the term "annular magnetic core" includes all magnetic cores having at least one continuous opening surrounded by magnetic material; hence, the magnetic cores can also be rectangular, square or oval and they can also be provided with more than one opening, e.g. double-hole cores. In these cases, the opening in the basic body should, of course, be adapted to the cross-sectional shape of the magnetic core.

Within the scope of the present invention, the term "HF magnetic-coil arrangement" also includes the fact that other electric components, e.g. capacitors or resistors, which are incorporated in the surface or surfaces of the basic body or in the interior thereof, may additionally be provided. To make things easier, the invention will, however, only be described on the basis of individual arrangements with magnetic cores having a circular cross-section.

The present invention will be explained in detail hereinbelow.

The basic concept of the present invention is to be seen in the idea of producing the individual turns of the at least one winding by fitting together conductor elements, which are applied to the area of the end faces, as well as plated-through holes in openings so as to achieve a completely mechanical or almost completely mechanical, but still economy-priced series production with constantly high quality with regard to the electric properties. An essential aspect of the present invention is seen in the use of a basic body, which has inserted therein the annular core, and in the fact that the subsections of the individual turns, which extend parallel to the axis of the annular core, are accommodated in holes of this basic body. Depending on the material used and depending on the thickness of said material, holes having diameters down to 0.1 mm can still be produced by means of metal drills. In the case of diameters of holes which are smaller than that, it will be advisable to employ laser drilling. Subsequently, through-hole plating of these holes is carried out, and, depending on the material and dimensions in question, it will be possible to use various methods for this purpose. In the case of larger diameters around 0.3 mm, an electrically conductive paste can be forced into these holes or liquid soldering tin can be pressed thereinto. A method having special importance in this connection is an electroplating method. The application of electrically conductive coatings to the surfaces of plastic bodies by means of electroplating is sufficiently known. However, in the case of very small diameters of holes, it may happen that the electroplating liquid no longer penetrates into the holes automatically. In this case, it will be possible to produce a vacuum above the electroplating bath, into which the basic body is inserted, for a short period of time or also in a pulsating fashion, whereby the electroplating liquid will be sucked into the capillary hole. The use of ultrasonic sound permits high penetration depths even in the case of narrow holes.

The basic body, which receives the magnetic core therein, has respective subsections of the turns extending at right angles to the holes applied to one of its sides, which is referred to as bottom side, either prior to through-hole plating through said holes, or said application is carried out only subsequently. Said application can be effected either by providing the whole surface with an electrically conductive coating and by etching the unnecessary parts away, or the respective conductors can be applied separately by printing or by evaporation. The subsections which are then still missing for making the coils complete are obtained by a cover member, which is applied to the basic body on the side located opposite the bottom side and which, similar to said bottom side, includes conductor elements, which have been applied thereto. Depending on the technology used, this cover member can be attached prior to or subsequent to the drilling operation.

Through-hole plating of conductors is known. When this technology is used, the cover can be attached subsequently. The other possibility is attaching the cover prior to the drilling operation and providing said cover simultaneously with the basic body with holes by means of drilling, whereupon through-hole plating of the cover can be carried out with the aid of one of the methods described.

In view of the fact that all these method steps can be carried out mechanically, a large number of pieces of such coils or toroidal core transformers in a raster of e.g. 100×100 elements can be produced simultaneously, and the finished components are subsequently separated from one another—as is known in connection with wafers—by sawing them to pieces or by some other separation process.

Instead of providing a basic body in the case of which the metallic connections parallel to the axis of the magnetic core are realized subsequently through holes, it is also possible to take a course of action in the case of which conductor webs are formed by applying an electrically conductive material in layers. In this case, a basic board is used, which has applied thereto electrically conductive material, e.g. silver, at the locations at which these conductors are to be produced, said application being effected e.g. by evaporation or by printing. By means of this method, metallic columns having the desired dimensions, viz. a length of several millimeters and a diameter of approx. 0.1 mm, can be produced; in this respect, it can be expedient to carry out the application operation in several steps so that the material which has already been applied will be hardened by tempering and mechanically stabilized. In the case of this method, it will be advisable to arrange the magnetic cores on this basic board already prior to the application of the column-shaped conductors and to fix them firmly to this board, whereby these column-shaped conductor webs can be brought to a position in very close vicinity to a position where they would abut on the magnetic cores. The then still open space between the surface and the upper edge of the magnetic cores is, subsequently, filled by an electrically insulating material, e.g. a plastic material; a dipping bath, or a spray-type or pressure-type method will be well suited for this purpose.

A similar method used for forming column-shaped conductors can be achieved by making use of the whisker technology. This method is a method which has already been known for years and in the case of which, on the basis of electrolytic deposition and in particular on the basis of condensation from the gaseous phase, also metals can be formed by nucleation, usually in a hydrocarbon atmosphere, as rods of a material, which have diameters of up to 1 μm and lengths of up to several millimeters.

A preferred additional method comprises the following method steps:

a) providing a prefabricated board of cast resin with a matrix of a plurality of continuous apertures which define the openings and with at least two reference openings, placing said board then on a flat, heated support, whereupon casting resin is filled into each opening in an amount which takes into account the volume of the future magnetic core to be inserted, b) inserting into the openings annular magnetic cores of ferrite material, which have been tested electrically and with regard to dimensional accuracy, and filling empty spaces which may perhaps still exist, in particular in the interior of the magnetic cores, with casting resin, c) drying the thus prepared board at 60° C. and curing it then 120° C., d) grinding, if necessary, the large surfaces of the boards such that plane parallelism is obtained, e) applying a cleaned composite film (thickness 25 μm) consisting of a film of polyimide, which is highly heat-resistant and which does not have any melting temperature (Kapton film), and of copper (thickness 17 μm) to the respective plane-parallel surfaces of the board, f) subjecting the thus prepared board—fixed between two heating plates—to renewed drying at 60° C. and curing it subsequently at 120° C., g) arranging the board in a defined mode of arrangement on a device while making use of the reference openings as a centering aid, and producing the openings for through-hole plating under the control of a computer in accordance with a given pattern in which the desired numbers of turns are taken into account, h) producing the plated-through holes in said openings by electrodeposition of metal (copper) on the interior walls of said openings in accordance with methods which are known per se, i) producing the conductors, which connect the metallizations within said openings in accordance with the pattern of extension required for the turns of the windings, the contact areas for connecting the windings to the printed SMD circuit, and the conductors, which connect the ends of the respective windings to the contact areas, according to the predetermined pattern, which is to be used in the case of step g) as well, by etching the copper film in accordance with methods known from the production of printed circuits, j) subjecting the finished transformer to automatic electric testing and dividing, prior to or subsequent to such testing, the board into the individual transformers especially by sawing along predetermined separation lines.

A modification of this method provides that a board of thermoplastic material is used instead of a board of cast resin and that the spaces in the openings between the magnetic cores and the board are filled with curable cast resin.

BRIEF DESCRIPTION OF THE DRAWINGS

On the basis of the embodiments shown in the figures, the present invention is explained together with examples.

DESCRIPTION OF THE PREFERRED EMBODIMENT

Figure 1:
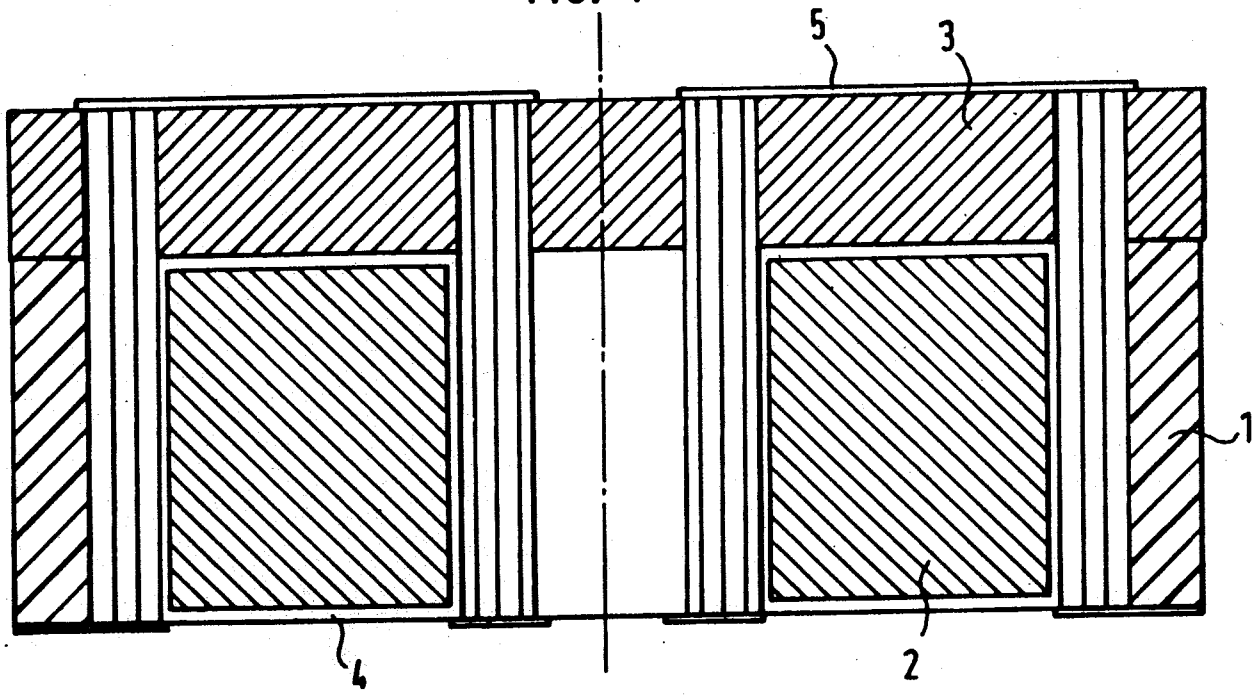
FIG. 1 shows a section through a toroidal core transformer having a cover and a bottom member.

The toroidal core transformer according to FIG. 1 comprises a basic body 1, an annular magnetic core 2 inserted in said basic body, and a cover 3. The basic body 1 is, for example, a thermoplastic body, and it is provided with an opening having the size of the magnetic core 2. This opening has inserted therein the magnetic core 2. Said magnetic core 2 has an outer diameter of approx. 4 mm and an inner diameter of approx. 1.5 mm. The basic body 1 consists e.g. of thermoplastic material in the case of which the opening for the magnetic core is already provided in the course of the production process, or of a material in the case of which said opening is produced subsequently, e.g. by drilling.

When inserted in the basic body 1, the magnetic core 2 is flush with the surface of said basic body 1. The height of the basic body 1 exceeds the height of the magnetic core by approx. 0.5 mm so that said basic body 1 has a closed, non-interrupted bottom surface 4. The cover 3 has a layer thickness of approx. 1 mm. The outer surface of the cover 3 as well as the bottom surface of the basic body 1 are provided with electric conductors 5, which have been applied by evapporation or by printing and the ends of which connect a respective point above or below the core opening of the magnetic core 2 with a point outside of the magnetic core 2.

Figure 2:
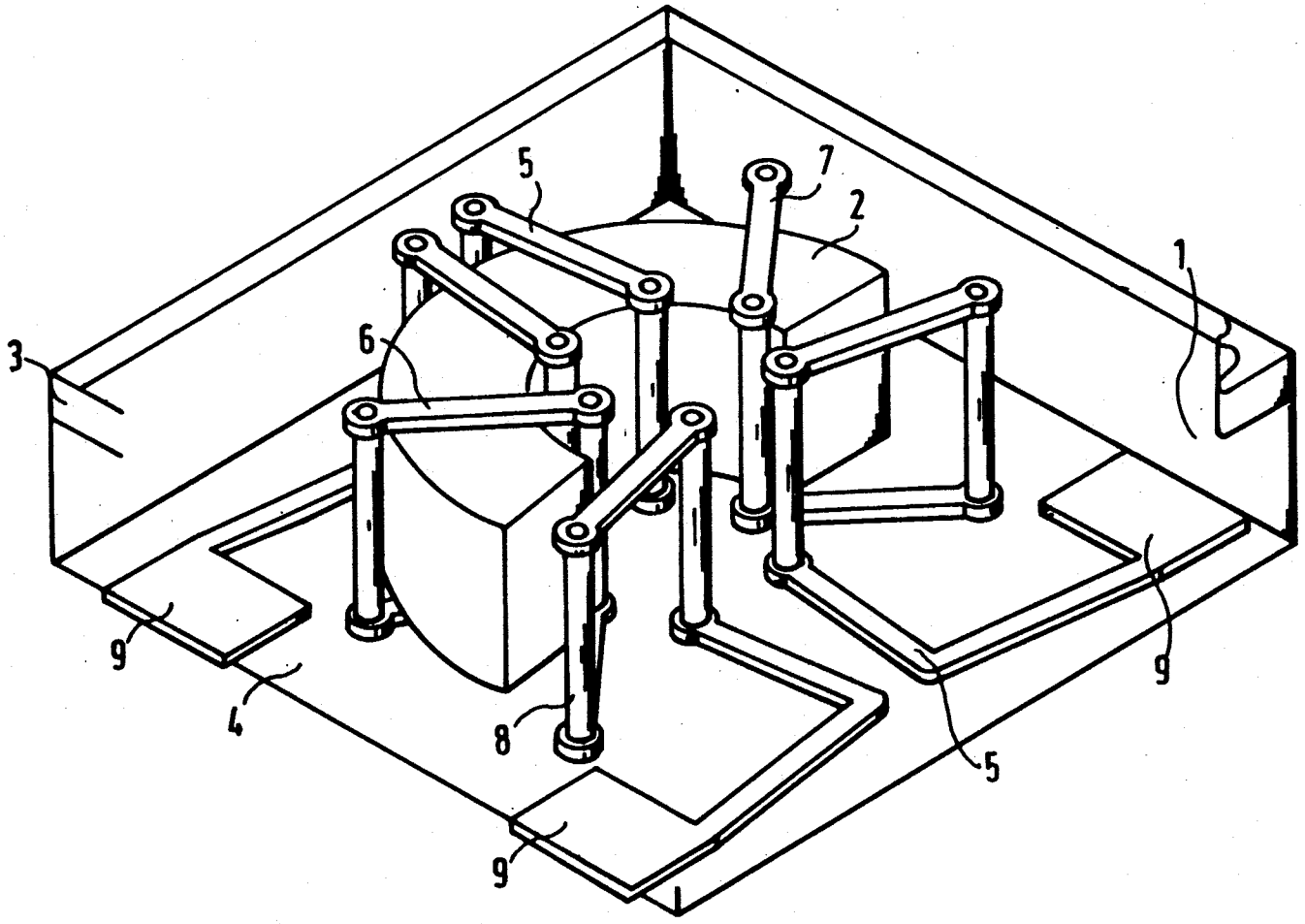
FIG. 2 shows a cut-open toroidal core transformer according to FIG. 1.

FIG. 2 shows very clearly how the conductors extend in the case of a toroidal core transformer with two coils 6 and 7. The respective horizontally extending conductor elements of the turns are formed by the conductors 5, which are provided on the cover 3 and on the bottom surface 4 of the basic body 1, respectively, and which have already been mentioned hereinbefore. The respective vertically extending subsections 8 of the turns of the coils 6 and 7 are realized by holes extending through the basic body 1 in the axial direction of the magnetic core 2. In the case of the embodiment shown, these holes have a diameter of 0.3 mm. They are filled with an electrically conductive material and each of them connects an electric conductor on the bottom surface 4 with a conductor on the cover 3.

In the following, a method of producing a toroidal core transformer will be described, in the case of which the opening in the basic body is not a continuous opening, according to FIG. 1 and 2.

In a matrix board of thermoplastic material having a size of 16 cm×16 cm, 20×20=400 openings for 400 toroidal cores are provided, the distance between the individual openings being 8 mm. This matrix board is equipped with 400 magnetic cores 2 having the dimensions indicated hereinbefore. The bottom surface of said matrix board is provided with a thin copper layer of the type known from printed circuits; if desired, it can also be provided with an underlying thin polyimide film (Kapton film). Subsequently, the cover member 3 is attached to the equipped matrix board by means of an adhesive or by means of welding. Also the cover member 3 is provided with a continuous conductor layer on its outer surface. Following this, the individual holes, which are to form the above-mentioned vertical subsections 8 of the coils 6 and 7, will be drilled through the cover member 3 and the matrix board in an automatic process. Processes which would be well suited for carrying out this operation are e.g. a laser drilling process or a mechanical drilling process. By means of mechanical drilling, diameters of holes down to 0.1 mm can be dealt with, whereas laser drilling can be used for reproducing diameters which are even smaller than that. Subsequently, the holes are filled fully or partly with an electrically conductive material in such a way that through-hole plating between the electric conductors of the bottom surface and of the cover 3 is effected. Means which are adapted to be used for this purpose are either an electrically conductive paste, which is injected under pressure in the case of very small diameters of the respective holes, or it is possible to use a method of electroplating surfaces of plastic material. In the case of very small diameters of the respective holes, it will be advisable to expel the air contained in said holes by using a vacuum. In view of the fact that, with the exception of said holes, the bottom surface 4 of the matrix board is completely closed, it will also be possible to apply pressure to said surface and to force the electroplating liquid from this side through said holes, or it will be possible to apply a vacuum to this side for sucking said electroplating liquid through from the other side until the holes have been closed fully or partly.

Suitable methods are described e.g. in the periodical "productronic ½-1988, pages 80 to 82" in connection with through-hole plating of printed circuit boards. In particular the squeegee method, which is discussed in said periodical and which is used for forcing the liquid through the respective holes, seems to be relevant in connection with the present purpose.

As soon as the electrically conductive connections through said holes to the respective conductors 5 on the cover 3 and on the bottom surface 4 have been obtained, the electric conductors will be produced on these two last-mentioned components by a conventional photo-etch process by removing the superfluous conductive areas on these two surfaces. Selectively, the conductors can also be applied by printing or by embossing. Following this, the two conductor-carrying surfaces of the cover 3 and of the bottom surface 4 are provided with a resin coating so as to mechanically protect these surfaces; this resin coating can be applied in a dipping bath. In so doing, attention should, however, be paid to the fact that the contact areas 9 (connection pads) for the coils 6 and 7 must not be covered with said resin coating, and this can be achieved e.g. by applying some other coating previously. This previously applied coating will then be removed and the whole board will be passed through a solder dipping bath, which will have the effect that these connection pads 9 will then slightly project as tin solder protrusions so that the future toroidal core transformer will have the structural design of a SMD component.

Subsequently, the 400 toroidal core transformers, which are still interconnected by the matrix board, will be electrically tested, and, in so doing, any defective transformers will be have applied thereto a colour spot.

After the testing, the matrix board will be sawn to pieces so as to separate the toroidal core transformers from one another.

Depending on the diameter of the holes which have been used for effecting through-hole plating, it may be necessary to clean the holes prior to inserting the electric conductor. A method which is well suited for this purpose is e.g. a plasma cleaning method of the type described, for example, in the periodical "productronic ½-1988, pages 71-72".

Figure 3:
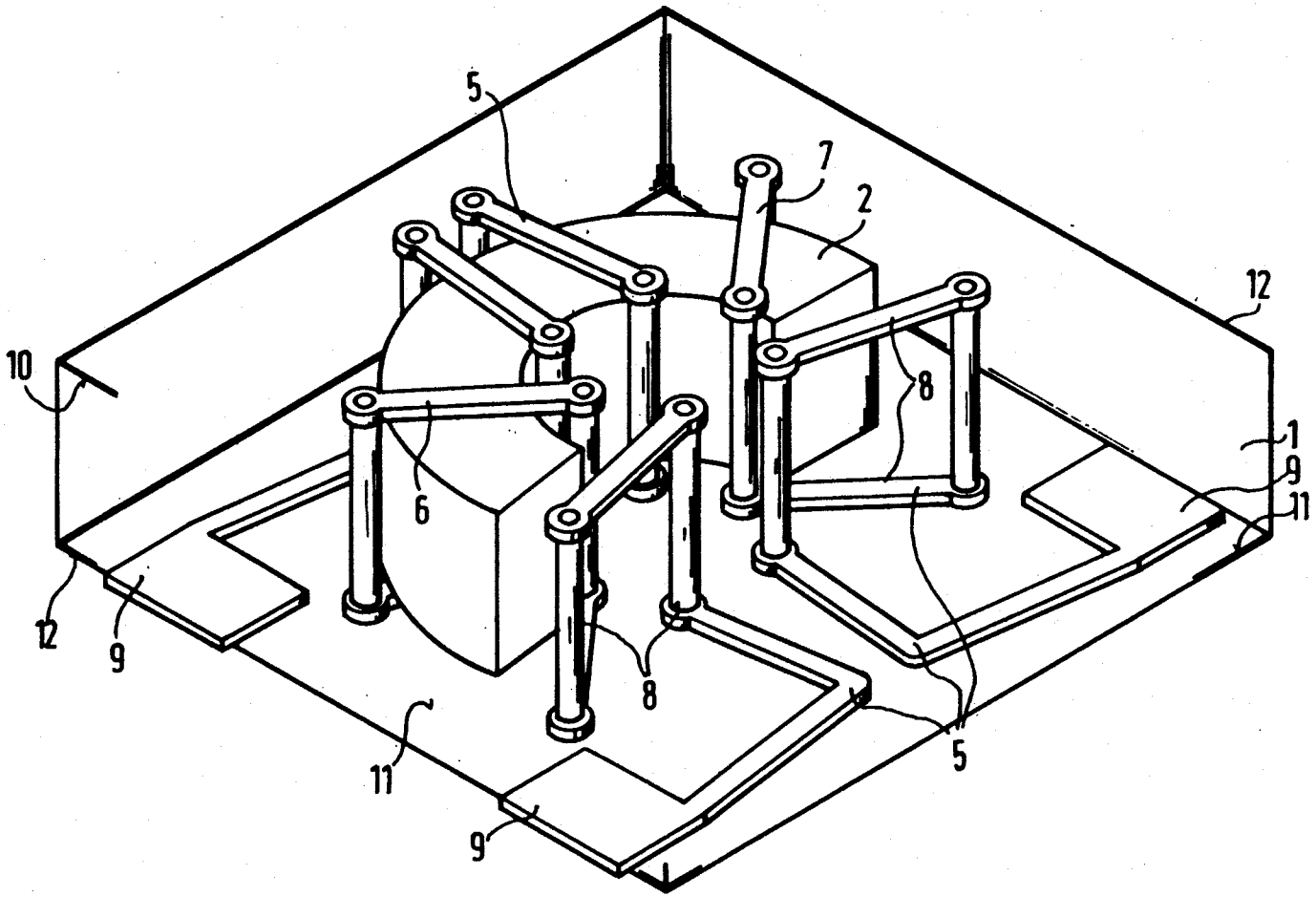
FIG. 3 shows, in a perspective view, an embodiment of a toroidal core transformer, which has been improved in comparison with FIG. 1 and 2 and which is provided with a continuous opening.

The embodiment shown in FIG. 3 differs from the embodiment according to FIG. 1 and 2 insofar as the cover 3 has been omitted. Also the bottom member 4 has a different structural design, as will become evident from the explanation of FIG. 4, since it is provided with a continuous opening for the magnetic core, said opening being filled with casting resin. As for the rest, identical reference numerals will be used for parts which are identical with those shown in FIG. 1 and 2. The conductors 5 on the upper side 10 and on the lower side 11 of the basic body 1 are located on films 12 of polyimide.

Films of polyimide are commercially available under the trademark of "Kapton". These films are highly heat-resistant, i.e. they resist high temperatures, and they do not have any melting temperature—they only carbonize at a temperature of approx. 800° C.—and they have a very high electrical resistance. Having these properties, they are used as a heat buffer upon curing of the cast resin as well as during the subsequent cooling down.

Figure 4:
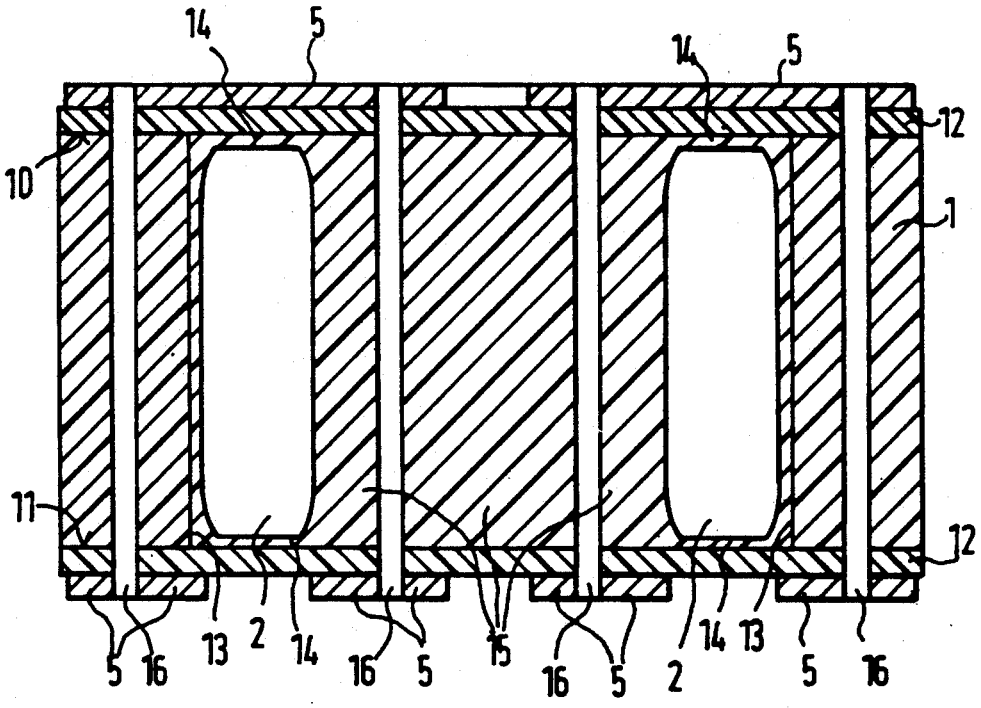
FIG. 4 shows a section through the toroidal core transformer according to FIG. 3.

On the basis of FIG. 4, a production method for a toroidal core transformer according to FIG. 3 will be described hereinbelow. As far as identical or corresponding method steps as in the case of the core transformer according to FIG. 1 and 2 are to be used, such as method steps for producing the holes, the conductors on the surfaces of the basic body, the metallization within the holes or the connection pads, the explanation will not be repeated.

First of all, one or several boards consisting of castable epoxy resin and having the desired dimensions (length, width, thickness) are cast in a vacuum and cured at approx. 120° C. The opening 13 is outlined in the drawing by broken lines, since, due to future common curing of the basic body 1 and of the filling 15 consisting of the same casting resin, it will practically no longer be possible to see any transition. The openings 13 for the magnetic cores 2 (consisting e.g. of ferromagnetic ceramic material) are precisely positioned as a matrix in accordance with the number of the transformers to be produced, in the case of a board having the dimensions 16 cm×16 cm, for example, 400 openings 13, and they are drilled through the board, or, e.g. for double-hole cores, they will be produced by milling. In addition, two holes serving as reference holes will be drilled at defined locations. However, the board can also consist of thermoplastic material, e.g. of polyamide, which has a particularly low epsilon value.

The magnetic cores 2, which are to be inserted into said holes 13, are tested electrically and with regard to dimensional accuracy and are then inserted into said holes 13 of the board, which rests on a flat, heated support, e.g. a glass plate; prior to said insertion, a small amount of casting resin was filled into the openings 13, and this can especially be done fully automatically. The interior of the magnetic cores 2 will then be filled with the same casting resin. In view of the fact that the thickness of the board is chosen such that it slightly exceeds, e.g. by 0.5 mm, the height of the magnetic cores 2, thin insulating layers 14, which consist of the same casting resin as the filling 15 in the interior of the magnetic cores 2, will be produced. The casting resin for the interior of the magnetic cores 2 may also be filled with ferrite powder so as to influence the electric properties of the whole structure in a desired manner.

The thus prepared board will then be dried at 60° C. and, subsequently, cured at 12° C. If necessary, the cured board will be subjected to a grinding process so as to guarantee the necessary plane-parallelism required for further processing.

After a cleaning process carried out by means of fat-dissolving and dirt-eliminating agents, it will be advisable to dry the board in a furnace at 100° C. Following this, each side of the board has applied thereto composite films, which were thoroughly cleaned as well and which consist of a polyimide film of the type described hereinbefore (having a thickness of 25 μm) and of a copper coating (having a thickness of 17 μm). This application is effected by rolling on of the composite films.

Finally, the structure is fixed between two plates, dried and cured again.

Subsequently, the board will be fixed on a device, in a position defined by its reference holes, and said device will be employed for producing, in particular for drilling, the openings 16 for the plated-through holes in accordance with the predetermined pattern, which takes into account the number as well as the position of the turns and windings of the individual coils.

This predetermined pattern, which can be referred to as layout, is produced in a computer-controlled fashion and has the taps, which are required for the necessary numbers of turns of the desired windings, and it also includes the masks for the future production of the conductors 5.

Subsequently, through-hole plating of the boards will be effected by producing with the aid of galvanic means metal coatings on the inner surfaces of the holes 16. Following this, a photoresist will be applied to the copper layers of the upper side 10 and of the lower side 11, the pattern for the conductors will be produced while making use of the layout, an exposure will be carried out and etching will be effected in a manner known per se so as to produce the conductors 5.

A board with a plurality of HF magnetic-coil arrangements will thus be produced, and electric testing of these HF magnetic-coil arrangements is already possible in this condition. Using a circular saw, the individual arrangements will then be separated by cuts along predetermined lines.

If necessary, the individual components can, moreover, be soldered to a corpus, which has specially been produced for SMD circuits, and they may also be provided with a protection cap, whereupon they will be ready for final testing.

We claim:

1. A method of producing a chip-type HF magnetic coil arrangement, comprising the steps of:

locating a toroidal magnetic core within an annular opening in an insulating basic body (1), the annular opening corresponding to a size of the toroidal magnetic core, the basic body having a bottom side and being composed of an embedding plastic material, the core extending about an axis and in an axial direction;

attaching a cover to the basic body for enclosing the core;

providing a first plurality of holes which extend through the basic body in the axial direction of the core so that the holes extend radially outside of the core and providing a second plurality of holes which extend through the basic body in the axial direction of the core so that the holes extend radially inside of the core; and forming at least one winding which extends around the core in turns, the step of forming including extending an electrically conductive material (8) within each of first and second plurality of holes and fully between the cover and the bottom side of the basic body;

providing a first plurality of conductors (5) on the bottom side of the basic body each being arranged for electrically connecting the conductive material within respective ones of the first and second plurality of holes; and providing a second plurality of conductors on the cover each being arranged for electrically connecting the conductive material within respective ones of the first and second plurality of holes, whereby the steps of providing the first and second pluralities of conductor elements include arranging the first and second plurality of conductors in an arrangement which, together with the conductive material within the first and second plurality of holes, constitute the turns of the at least one winding.

2. A method of producing a chip-type HF magnetic-coil arrangement according to claim 1, characterized in that each of the conductors (5) is etched from a copper film, said copper films being applied to a respective film (12) of polyimide, which is highly heat-resistant and arranged between the respective surface of the basic body (1) and the copper film.

3. A chip-type HF magnetic-coil arrangement according to claim 1, characterized in that the cover has holes, which are coaxial with the holes in the basic body and which are plated and are soldered with soldering material to the electrically conductive material in the holes provided in the basic body (1).

4. A method of producing a chip-type HF magnetic-coil arrangement according to claim 3, characterized in that the soldering material used has a melting point being at least 300° C.

5. A method of producing a chip-type HF magnetic-coil arrangement according to claim 1, characterized in that the basic body (1) consists of a thermoplastic material in which the openings (13) for the magnetic cores (2) have been thermally produced.

6. A method of producing a chip-type HF magnetic-coil arrangement according to claim 1, characterized in that the basic body (1) consists of a board having provided therein a plurality of openings (13) in the form of a matrix so as to form simultaneously a corresponding plurality of toroidal core transformers, and that these toroidal core transformers are subsequently separated by means of separation cuts.

7. A method of producing a chip-type HF magnetic-coil arrangement according to claim 1, characterized in that the basic body (1) consist of cured cast resin, that spaces between the basic body (1) and the magnetic core (2) as well as radially inside of said magnetic core (2) are filled with the same cast resin, and that the cast resin of the basic body (1) forms together with the filling cast resin (15) a homogeneous body due to joint curing.

8. A method of producing a chip-type HF magnetic-coil arrangement according to claim 1, characterized in that the cast resin is an epoxy resin.

9. A method of producing a chip-type HF magnetic-coil arrangement according to claim 1, characterized in that the filling cast resin is filled with ferrite powder.

10. A method of producing a chip-type HF magnetic-coil arrangement according to claim 1, characterized in that the step of extending an electrically conductive material includes applying the electrically conductive material to said basic body to produce column-shaped conductors in said basic body.

11. A method according to claim 10, characterized in that the step of applying includes evaporation carried out with silver.

12. A method according to claim 11, characterized in that the step of applying includes applying individual layers having a maximum thickness of 0.1 mm and then subjecting each of said layers to thermal tempering.

13. A method according to claim 10, characterized in that the step of applying includes whisker growth.

14. A method of producing a chip-type HF magnetic coil arrangement, comprising the steps of:

locating a toroidal magnetic core within an annular opening in an insulating basic body (1), the annular opening corresponding to a size of the toroidal magnetic core, the basic body having a bottom side (11) and an upper side (10) and being composed of an embedding plastic material, the core extending about an axis and in an axial direction;

providing a first plurality of holes through the basic body in the axis direction of the core so that the holes extend radially outside of the core and providing a second plurality of holes through the basic body in the axial direction of the core so that the holes extend radially inside of the core; and forming at least one winding which extends around the core in turns, the step of forming including extending an electrically conductive material (8) within each of first and second plurality of holes and fully between the upper and bottom sides of the basic body;

providing a first plurality of conductors (5) on the bottom side of the basic body each being arranged for electrically connecting the conductive material within respective ones of the first and second plurality of holes; and providing a second plurality of conductors on the upper side of the basic body each being arranged for electrically connecting the conductive material within respective ones of the first and second plurality of holes, whereby the steps of providing the first and second pluralities of holes include arranging the first and second plurality of conductors in an arrangement which, together with the conductive material within the first and second plurality of holes, constitute the turns of the at least one winding.

15. A method of producing a chip-type magnetic-coil arrangement according to claim 14;

characterized by the following method steps:

a) providing a prefabricated board which includes the basic body, the board having a matrix of a plurality of continuous apertures which define openings, then placing said board then on a flat, heated support, whereupon casting resin is filled into each opening in an amount which takes into account the volume of each magnetic core to be inserted respectively in the openings, b) inserting into the openings respective annular magnetic cores of ferrite material, and then filling any remaining empty spaces in the openings with casting resin, c) thereafter drying the board and then curing the dried board, d) grinding, if necessary, top and bottom surfaces of the board such that plane parallelism of the top and bottom surfaces is obtained, e) applying a cleaned composite film to the respective plane-parallel surfaces of the board, f) after the steps of d) and e), subjecting the board to renewed drying and curing subsequently, g) arranging the board in a defined mode of arrangement on a device, and producing the openings in accordance with a given pattern in which the desired number of turns are taken into account, h) producing plated-through holes in said openings by electrodeposition of metal on interior walls of said openings.

16. A method according to claim 15, characterized in that the step h) includes galvanic plating through the holes.

17. A method according to claim 15, characterized in that any air which may be contained in the holes is removed therefrom by making use of a vacuum.

18. A method according to claim 15, characterized in that the step h) includes pressing electroplating liquid into the holes by means of squeegees.

19. A method according to claim 15, wherein the prefabricated board is composed of a cast resin.

20. A method according to claim 15, wherein the prefabricated board is composed of a thermoplastic material and the casting resin which fills the openings between the magnetic cores and the board is curable.

21. A method of producing a chip-type HF magnetic coil arrangement, comprising the steps of:

providing a structure composed of a basic body composed of an electrically insulating material and which defines an annular internal chamber in which is arranged a toroidal magnetic core, the structure having a top side and a bottom side;

providing a first plurality of holes through said basic body to extend radially outside of said magnetic core;

providing a second plurality of holes through said basic body to extend radially inside of said magnetic core; and forming at least one winding which extends around the core in turns, the step of forming including extending conductive material within each of said first and second plurality of holes and fully between the top and bottom sides;

providing a first plurality of electrical conductors on said top side for electrically connecting the conductive material in respective ones of said first and second plurality of holes;

providing a second plurality of electrical conductors on said bottom side for electrically connecting the conductive material in respective ones of said first and second plurality of holes;

whereby the steps of providing the first and second pluralities of holes include arranging the first and second plurality of conductors in an arrangement which, together with the conductive material within the first and second plurality of holes, constitute the turns of the at least one winding.

22. A method as in claim 21, characterized in that the top side of the structure includes a cover, the bottom side of the structure including a bottom of the basic body.

* * * * *